US010717121B2

(12) United States Patent
Song et al.

(10) Patent No.: US 10,717,121 B2
(45) Date of Patent: Jul. 21, 2020

(54) CONTINUOUS SCRAPING ALUMINUM ROD BY MOLDS FOR PRECISION EXTRUSION

(71) Applicants: Jay Song, Aliso Viejo, CA (US); Haitao Wu, Hangzhou (CN)

(72) Inventors: Jay Song, Aliso Viejo, CA (US); Haitao Wu, Hangzhou (CN)

( * ) Notice: Subject to any disclaimer, the term of this patent is extended or adjusted under 35 U.S.C. 154(b) by 330 days.

(21) Appl. No.: 14/822,908

(22) Filed: Aug. 11, 2015

(65) Prior Publication Data

US 2017/0043384 A1 Feb. 16, 2017

(51) Int. Cl.
*B21C 23/32* (2006.01)

(52) U.S. Cl.
CPC ..... *B21C 23/32* (2013.01)

(58) Field of Classification Search
CPC ..... B21C 23/32; B21C 35/06; B21C 43/02; B21C 43/04
See application file for complete search history.

(56) References Cited

U.S. PATENT DOCUMENTS 3,760,488 A * 9/1973 Cucuz ..... B21C 43/02 29/424

* cited by examiner

*Primary Examiner* — Debra M Sullivan

(57) ABSTRACT

The present invention provides a mold method for surface treatment of aluminum component comprising: providing straightening and rounding the aluminum component; the scraping pretreatment; the oxidation prevention and lubrication of scraping; the precise scraping of the aluminum rod. The present invention enables on-line high precision shape finishing and surface cleaning of the aluminum component which satisfies the processing requirement of providing uniformity and consistent treatment by the subsequent extrusion processing as part of the production line in order to produce high quality aluminum, aluminum alloy, aluminum bimetallic and multi-metallic composite profiles and special profiles.

7 Claims, 8 Drawing Sheets

CONTINUOUS SCRAPING ALUMINUM ROD BY MOLDS FOR PRECISION EXTRUSION

CLAIM OF BENEFIT OF FILING DATE

This application claims the benefit of the filing date of U.S. Provisional Application Ser. No. 62/036,478 titled "Online Pretreatment of Aluminum Rod Surface for Continuous Production Line" filed on Aug. 12, 2014, which is incorporated herein by reference for all purposes.

FIELD OF THE INVENTION

The present invention relates to a new and useful method of continuous treatment for cleaning the surface of aluminum or its alloy components. More particularly, the present invention is suitable for on-line or off-line processing of aluminum or its alloy components to produce fresh and clean aluminum rods for precision extrusion processing in order to produce aluminum, aluminum alloy, aluminum bimetallic or multi-metallic composite profiles and special profiles.

BACKGROUND OF THE INVENTION

The invention of continuous extrusion has made a great change of traditional processing of non-ferrous metals, it is characterized by cancellation of heating and annealing process, which saves investment, reduces energy consumption, enhances output, simplifies production process, and solves the disadvantage of discontinuous processing and length limitation by traditional process. To continuously and precisely extrude aluminum profiles, it requires clean surface of the aluminum rod and precise control over the feed stock.

Aluminum is characterized by active chemical reaction, the fresh and clean surface of aluminum at room temperature can easily react with oxygen in the air to form an oxide layer. When continuously and precisely extruding aluminum profiles, the stored aluminum component needs to undergo on-line shape finishing and surface cleaning or the same processing off-line with additional protection before the processed aluminum rod can go on-line for subsequent processing.

Conventional methods of surface cleaning treatment of aluminum or its alloy components mainly include chemical cleaning, grinding, rotary peeling, and centrifugal gravity scraping. The chemical method uses alkali or acid to remove stains and oxides from the surface of the aluminum component, and then the lye and acid is rinsed and the aluminum component is dried. The disadvantage of the chemical method is the long processing flow which can easily cause secondary oxidation due to exposure to air and may also raise an environmental issue. The grinding method uses a grinding brush to repeatedly burnish the aluminum component in order to remove stains and oxides from its surface. The disadvantage of the grinding method is that the heat generated by friction induces secondary oxidation on the aluminum surface. The rotary peeling method is dedicatedly designed for aluminum rods, which places several peeling cutter sets along the advancing direction (axial) of the aluminum rod. The three peeling cutters of each set are evenly distributed on the rotary disk which comes with the self-centering mechanism and are tilted with the aluminum rod. All peeling cutter sets fully cover the surface of aluminum rod. The stored aluminum rod firstly goes through the shape finishing, then, goes through continuous peeling by the cutters. The surface of the aluminum rod is fully treated when all of the peeling cutters on the rotary disk and all of the sets are used. The disadvantage of the rotary peeling method is low precision and poor uniformity. The centrifugal gravity scraping method is also designed especially for aluminum rods, similar to the rotary disk structure. When the shape finished aluminum rod passes through the rotary disk, the mechanical structure of the rotary disk, which is affected by centrifugal gravity, drives the peeling tool into contact with the aluminum rod, peeling the surface layer. The disadvantage of this method is that the length of the aluminum rod is limited and less uniformity. The above-mentioned methods are not suitable for on-line surface scraping nor can they satisfy the processing requirement of providing uniformity and consistent treatment of the aluminum rod by high precision extrusion and continuous production.

To avoid the disadvantages of the above-mentioned methods when conducting on-line shape finishing and surface cleaning, there is an urgent need for high precision extrusion and continuous processing the aluminum profiles. To meet the need, one embodiment of the method uses highly precise molds scraping onto the aluminum component to accomplish shape finishing and surface cleaning. The present invention refers to the mold method which satisfies the requirement of providing uniformity and consistent of aluminum rods by precision extrusion and continuous processing of aluminum, aluminum alloy, aluminum bimetallic or multi-metallic composite profiles or special profiles. The method achieves precise control over the molding process and precision extrusion for the continuous production line.

SUMMARY OF THE INVENTION

The present invention provides a new and useful physical method of online surface treatment of aluminum components for continuous extrusion process. One embodiment of the method enables online high precision shape finishing and surface cleaning of aluminum component. The aluminum component is fed into the orientation guide unit for initial orientation, then in turn passes through the straightening unit, the roundness unit for fine straightening and rounding, the scraping pretreatment unit to carve a rifle line onto the surface of the aluminum rod, the intermediate orientation guide unit for further orientation, the oxidation prevention unit to prevent secondary oxidation, the scraping unit for precise scraping of the aluminum rod to produce a fresh and clean surface, the leading-out orientation guide unit for final orientation. The described process herein enables on-line high precision shape finishing and surface cleaning of the aluminum component which satisfies the processing requirement of providing uniformity and consistent treatment by the subsequent extrusion processing as part of the production line.

The present invention relates to the synchronization linkage of aluminum component with the processing system by traction of the continuous extrusion and subsequent process or independent power source, after on-line straightening, rounding, pretreatment of scraping, coating with rapid volatile anti-oxidation and lubrication fluid, and high precision surface scraping, the uniformity of the aluminum rod reaches ±0.01 mm, the scraping depth ranges of 0.01-1 mm.

The present invention possesses processing characteristics of short flow, high precision, low waste, and large output. After surface scraping, the aluminum rod is processed through the subsequent extrusion, temper modification, surface fining and other processing flows, to produce high quality aluminum, aluminum alloy, aluminum bimetallic and multi-metallic composite wires, strips, tubes, profiles and special profiles.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF THE INVENTION

Figure 1:
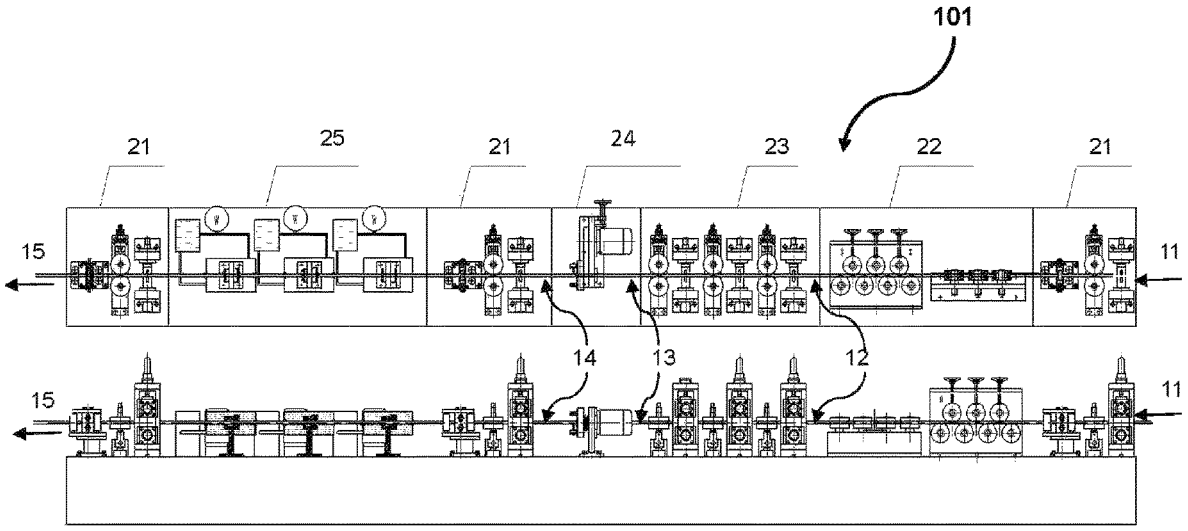
FIG. 1 is a schematic diagram illustrating the top view (upper diagram) and front view (lower diagram) of the on-line continuous processing of the shape finishing and surface cleaning of aluminum component in accordance to a mold method of the present invention.
Figure 8:
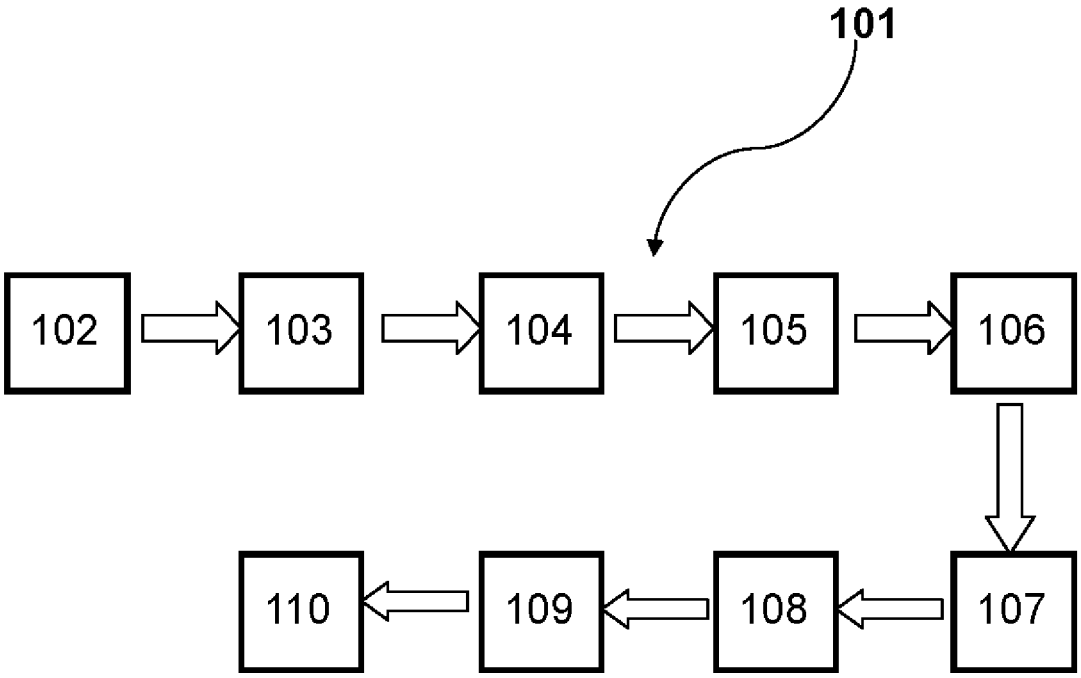
FIG. 8 is a flowchart of on-line continuous process surface cleaning of aluminum component in accordance to a mold method of the present invention.

Referring to FIGS. 1 and 8, the present invention relates to the shape finishing the aluminum component 11 (103, 104) and surface cleaning the aluminum rod 14 (108) by the mold method 101. These steps (103, 104, 108) provide the necessary surface treatment of the aluminum component 11 for online high precision extrusion and subsequent processing (110). The mold method (101) is comprised of the following units: an (leading-in) orientation guide unit 21, an on-line straightening unit 22, an on-line rounding unit 23, a scraping pretreatment unit 24, another (intermediate) orientation guide unit 21, an oxidation prevention and precise scraping unit 25, and another (leading-out) orientation guide unit 21.

Referring to FIGS. 1 and 8, the present invention relates to the aluminum component cleaning and shape finishing steps (103, 104, 108) and involves processing within the aluminum treatment by the mold method (101). The aluminum component 11 is placed under the traction of continuous extrusion and subsequent processing (110) or independent dynamic power source to synchronize linkage with the production system so that it (11) first goes through the leading-in orientation guide unit 21 to achieve desired or predetermined orientation (102). The aluminum component 11 is then processed by (i) on-line straightening unit 22 for straightening (103) (used for precise scraping); (ii) the on-line rounding unit 23 for rounding (104) (also used for precise scraping); (iii) the pretreatment scraping unit 24 to carve a rifle line onto the surface of aluminum rod (105); (iv) the intermediate orientation guide unit 21 for further orientation (106); (v) a oxidation prevention and precision scraping unit 26 for secondary oxidation prevention (107) and precision scraping (108) when the precise scraping unit 26 scrapes the aluminum component 11, as part of the scraping pretreatment (105), the aluminum scrapes will automatically break into small pieces and fall into a collection tank in order to avoid long scrapes causing collection issues and blocking operation; and (vi) the leading-out orientation guide unit 21 for final orientation (109). The described process herein enables online high precision shape finishing and surface cleaning of the aluminum component 11. The processed aluminum component 11 is subject to online straightening (103) and rounding (104), achieving the required straightness and roundness for precise surface scraping (108). By completing all of the above-described processes for the cleaning and shape finishing steps (103, 104, 108), the aluminum component now has a fresh and clean surface that satisfies the surface cleanliness and uniformity required by the subsequent steps (110) of the method (101). The cleaning and shape finishing steps (103, 104, 108) possesses characteristics of short-flow, high precision scraping, low wastage and large output. The uniformity of the aluminum component 11 reaches ±0.01 mm after the completion of these steps (103, 104, 108).

Figure 2:
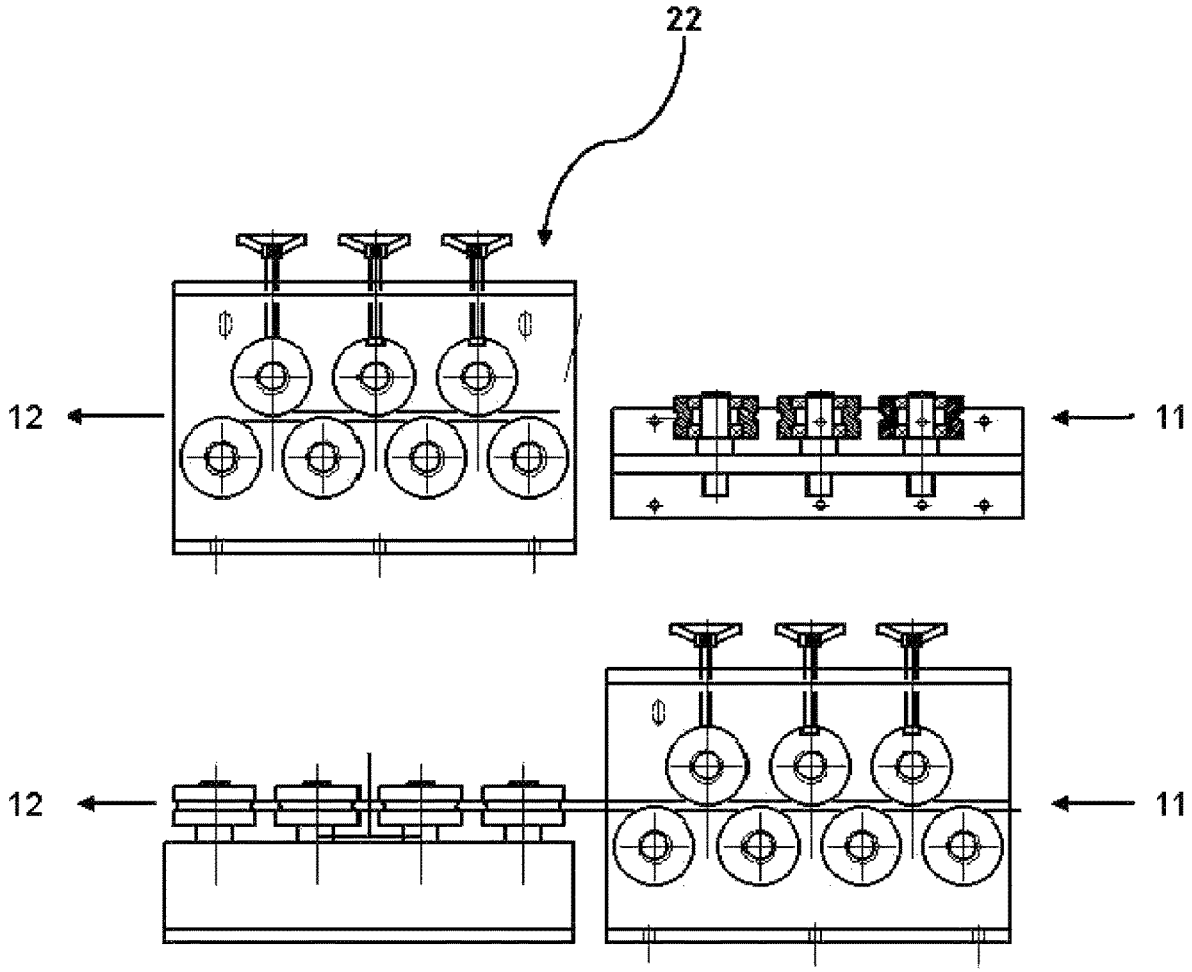
FIG. 2 is a schematic diagram illustrating the top view (upper diagram) and front view (lower diagram) of the structure of the straightness mold sets.

Referring to FIGS. 1, 2, and 8, by traction of the continuous extrusion and subsequent processing (110) or independent dynamic power source, the aluminum component 11 first passes through the orientation unit 21 which is composed of a pair of vertical roller mold and a pair of horizontal roller mold for orientation (102), then enters into the straightness unit 22 for online straightening (103). The unit 22 is composed of two series of mold sets, the first series of mold sets 35 are placed vertically (in reference to the ground) upper and lower corresponding and in staggered position to each other along the advancing (axial) direction, the second series of mold sets 36 are placed horizontally (in reference to the ground) left and right corresponding and in staggered position to each other along the advancing (axial) direction, either vertical or horizontal sets of the mold is composed of one to dozens of the groove roller mold (see FIG. 2). The actual sets of straightening mold 35, 36 depend on the condition of aluminum component 11, which include but are not limited to the material condition, initial shape and the direction of the feeding stock of the aluminum component 11. After straightening (103), the aluminum component 12 has achieved higher straightness. Typically, the harder the aluminum component and the greater the diameter, the more sets of straightening mold 35, 36 is required.

Figure 3:
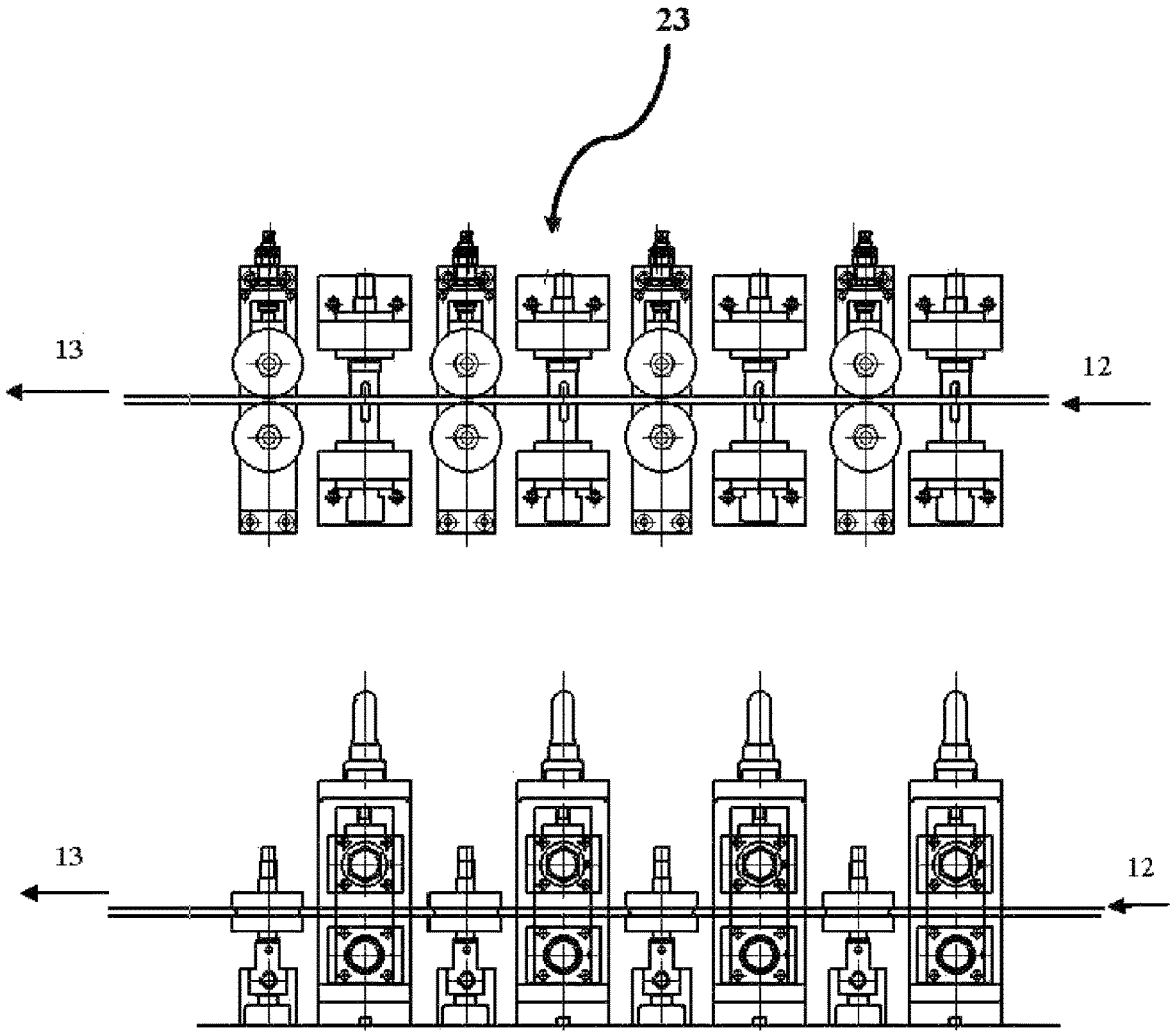
FIG. 3 is a schematic diagram illustrating the top view (upper diagram) and front view (lower diagram) of the structure of the roundness mold sets.

Referring to FIGS. 1, 3, and 8, by traction of continuous extrusion and subsequent processing (110) or independent dynamic power source, after straightening (103), the straightened aluminum component 12 enters into the roundness unit 23 for on-line rounding (104). The unit 23 is composed of a series of mold sets 37, each set consists of an asymmetrical pairing groove roller mold, which are in turn of vertically and horizontally repeat placed along the advancing (axial) direction (see FIG. 3). The actual rounding mold sets 37 depend on the condition of aluminum component 12, which include but are not limited to the material condition, the shape deviation and requirement of the processing precision. After rounding (104), the aluminum rod 13 has achieved the required diameter and roundness. Typically, the harder the material and the greater the diameter and deviation, the more sets of rounding mold 37 is required.

Figure 4:
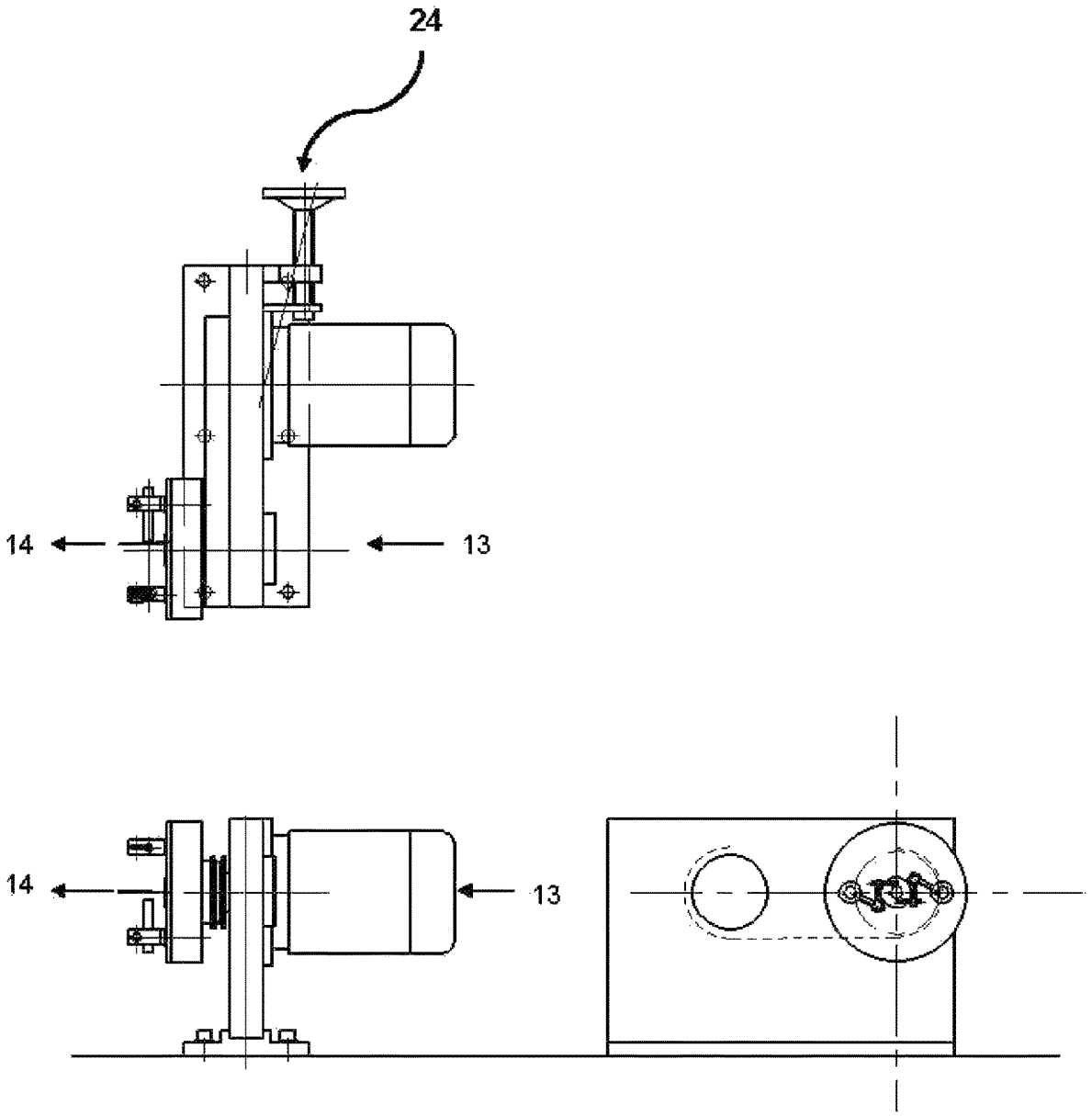
FIG. 4 is a schematic diagram illustrating the top view (upper diagram), the front view (lower left diagram) and the left-side view (lower right diagram) of the structure of the scraping pretreatment unit.

Referring to FIGS. 1, 4, and 8, after straightening (103) and rounding (104), the aluminum rod 13 is placed under the traction of the continuous extrusion and subsequent processing (110) or independent dynamic power source and moved along the axial by a liner speed of $V_L$ (1 m/min~100 m/min) to pass through the scraping pretreatment unit 24 for carving a rifle line onto the aluminum rod 13 in order to let the aluminum scrapes automatically break into small pieces and fall into collection tank to avoid long scrapes causing collection issue and blocking operation. The principle mechanism of the centrifugal scraping pretreatment unit 24 is that the rotational driving force of the wheel which holds the scraping tool is along a circular motion with constant angular speed $V_\omega$ (300 cycles/min—2500 cycles/min), the rotational scraping tool is set by an angle (5°~90°) to the axial, by combined effect of the liner motion axial speed $V_L$ and circular motion angular speed $V_\omega$, the scraping tool carves a rifle line onto the surface of the aluminum rod 13. The depth of the rifle line depends on diameter of the aluminum rod 13, usually ranged 0.01 mm~1 mm. It should be noted that the parameters provided herein and/or discussed elsewhere in this specification are not intended as being exhaustive or limiting of the present invention. Those skilled in the art may change the parameters as may be best suited to the requirements of a particular use and still be within the scope of the present invention.

Figure 5:
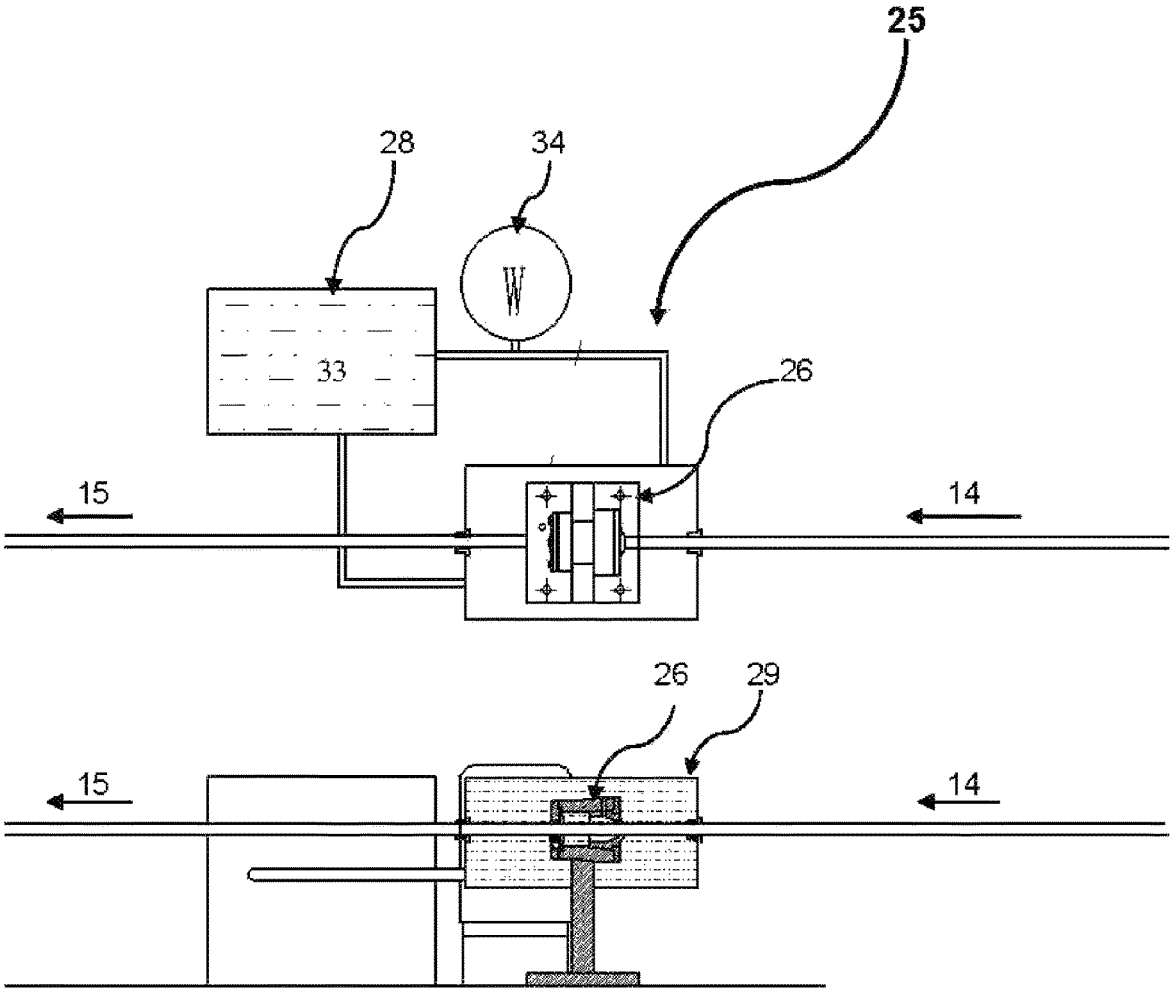
FIG. 5 is a schematic diagram illustrating the top view (upper diagram), the front view (lower diagram) of the anti-oxidation and lubrication system and the scraping cavity.

Referring to FIGS. 1, 5, 6, and 7, after the scraping pretreatment (105), the aluminum rod 14 continuously passes through the intermediary orientation guide unit 21 for further orientation (106) and enters into the oxidation prevention and lubrication unit 25 and scraping unit 26 for synchronous treatment of oxidation prevention and lubrication (107) and precise scraping 108. As shown in FIG. 5, the anti-oxidation and lubrication system is composed of the anti-oxidation and lubrication fluid 33, the storage container 28, the pump 34, the working container 29 and the connection pipes. The mold cavity 26 is filled with special volatile anti-oxidation and lubricating fluid 33 (see FIGS. 5, 6), While aluminum rod 14 passes through the mold cavity 26, the special volatile anti-oxidation and lubricating fluid 33 will be coated onto the surface of aluminum rod 14 and will lubricate the scraping mold 32 and protect the fresh and clean surface of aluminum rod 15 from secondary oxidation. The special volatile anti-oxidation and lubricating fluid 33 includes but is not limited to alcohol, acetone and other volatile organic chemicals or a combination of such.

Figure 6:
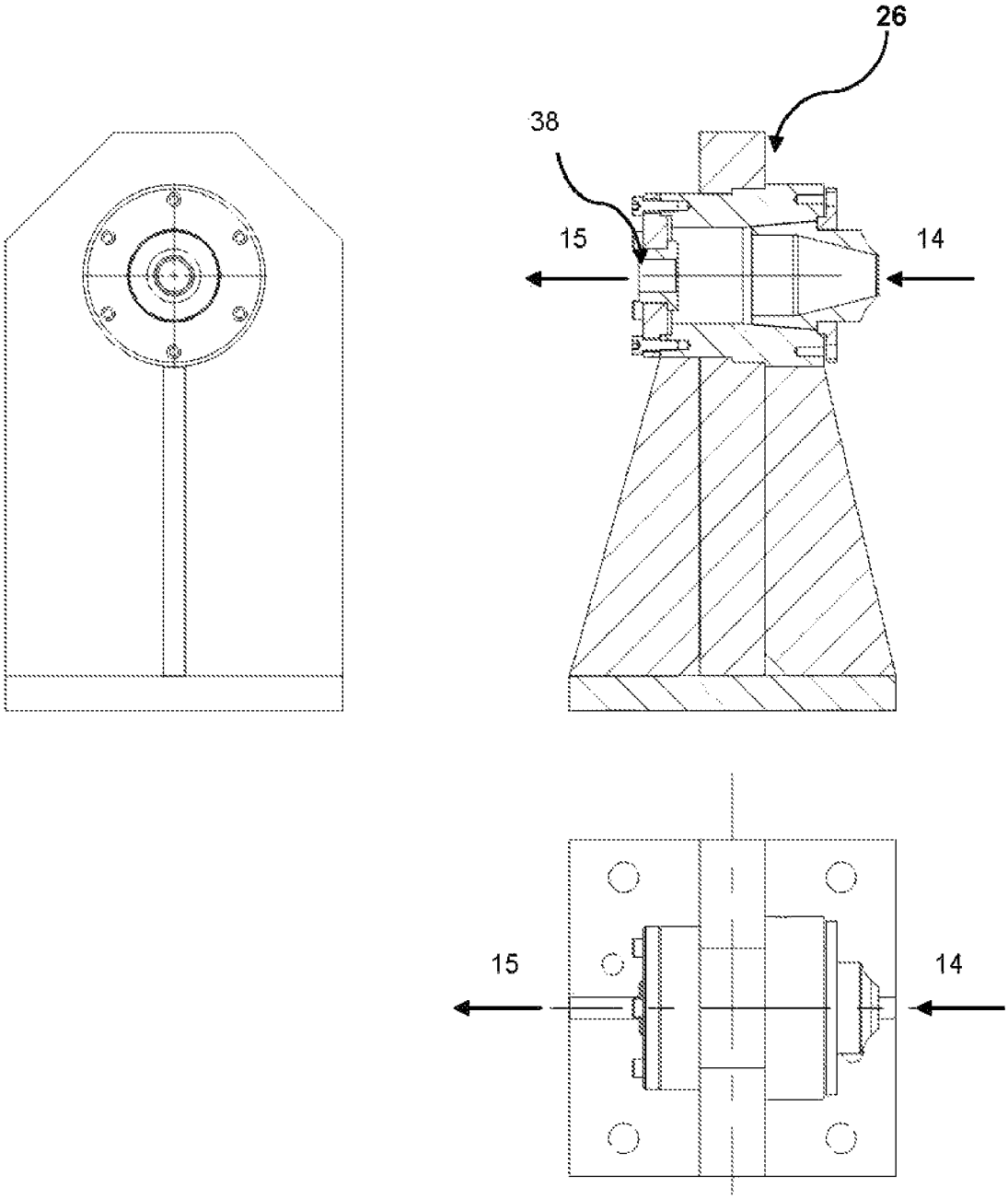
FIG. 6 is a schematic diagram illustrating the front, side and top view of the mold cavity and frame structure.
Figure 7:
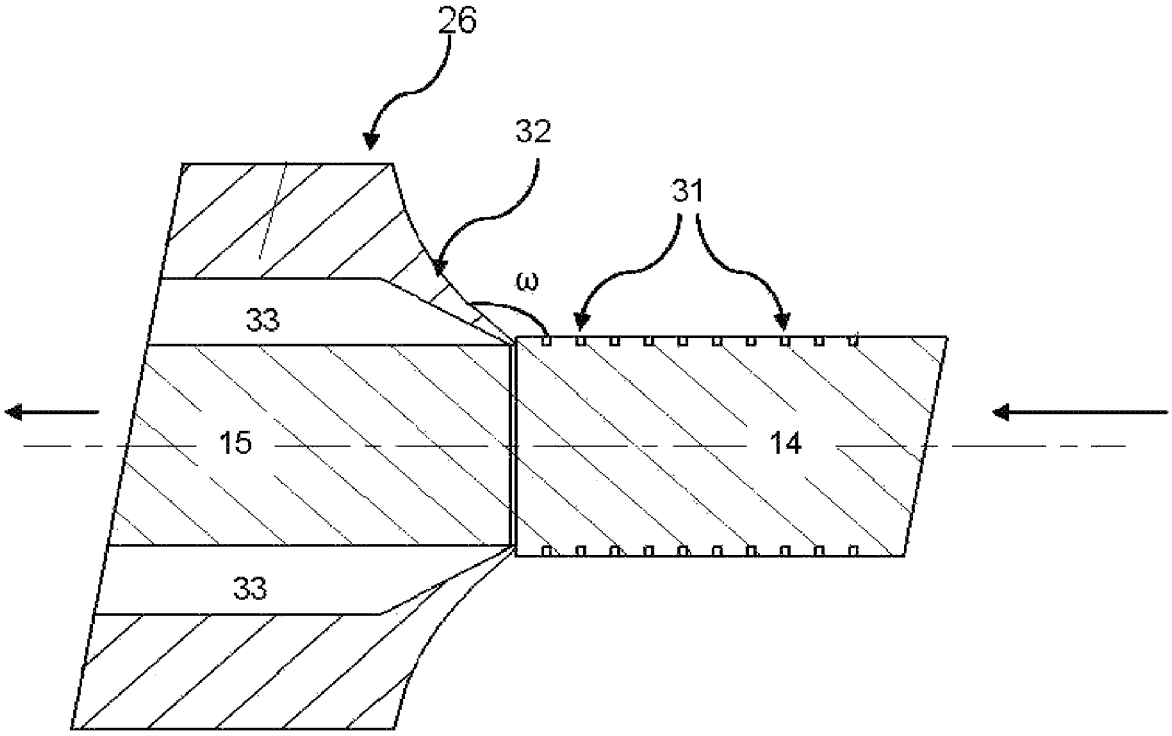
FIG. 7 is a cross-section view and a schematic diagram of the scraping mold cavity.

After going through straightening (103), rounding (104) and scraping pretreatment (105), the aluminum rod 14 satisfies the required straightness and roundness. Under the traction of continuous extrusion and subsequent processing (110) or independent dynamic power resource, the aluminum rod 14 undergoes high precision surface scraping (108). The structures of the scraping mold 32 and the mold cavity 26 as shown in FIGS. 5, 6, and 7. The scraping mold 32 has a round cutting edge which is angled ω (95°~180°) the aluminum rod 14. Behind the cutting edge, the mold cavity is structured as an open cone with gradually increased radius to avoid surface scratches on the aluminum rod 15 caused by the cavity wall due to accidental vibration. The surface layer of the aluminum rod 14 is shaved out when passing through the scraping mold 32, the uniformity of the aluminum rod 15 reaches ±0.01 mm after scraping (108). As part of the scraping pretreatment (105), the aluminum scrapes will automatically break into small pieces and fall into collection tank in order to avoid long scrapes causing collection issue and blocking operation. The peeling depth is ranged from 0.01 mm to 1 mm.

After the precise scraping (108), the aluminum rod 15 which is coated and protected by the special volatile anti-oxidation and lubricating fluid 33 continually passes through the anti-friction nylon sleeve set 38 in the rear end of the mold cavity 26 and goes through the leading-out orientation guide unit 21 for final orientation (109), before entering into the precision extrusion and subsequent processing (110) for preparation of aluminum, aluminum alloy, aluminum bimetallic and multi-metallic composite profiles and special profiles, the adhered volatile anti-oxidation and lubricating fluid 33 on the fresh and clean surface of aluminum rod 15 is evaporated prior to deformation by extrusion.

The invented shape finishing and surface cleaning by mold method (101) applies to other non-ferrous metals, alloy and composite components, such as copper, copper alloy, and copper composites, aluminum alloy and composites, and so on. In certain circumstance and condition, some steps of the invented mold method can be removed. It is understood that the present invention as described and claimed herein can be used for many additional purposes, therefore the invention is within the scope of other fields and uses and is not so limited. The explanations and illustrations presented herein are intended to acquaint others skilled in the art with the invention, its principles, and its practical application. Those skilled in the art may adapt and apply the invention in its numerous forms, as may be best suited to the requirements for a particular use. Accordingly, the specific embodiments of the present invention as set forth are not intended as being exhaustive or limiting of the invention. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes.

What is claimed is:

1. A processing method of continuous scraping aluminum rod by molds for precision extrusion comprising:

a. providing an aluminum component (11);

b. orientating the aluminum component (11) by a pair of vertical roller molds and a pair of horizontal roller molds;

c. straightening the aluminum component (11) to form a straightened aluminum component (12) with a series of upper and lower staggered groove roller molds and series of left and right staggered groove roller molds;

d. rounding the straightened aluminum component (12) to form a round aluminum rod (13) with a series of paired groove roller molds crossing in vertical and horizontal direction;

e. carving a rifle line onto the round aluminum rod (13) with a rotational scraping tool to form a pretreated aluminum rod (14) when passing through a centrifugal scraping pretreatment unit (24);

f. coating a volatile anti-oxidation lubricant (33) onto the surface of the pretreated aluminum rod (14) as it passes through a working container (29) which is filled with the volatile anti-oxidation lubricant (33);

g. scraping off a thin surface scrapings layer from the pretreated aluminum rod (14) with scraping molds (32) when passing through the working container (29), wherein (a) a clean aluminum rod (15) is thereby achieved;

(b) the thin surface scrapings layer breaks into small pieces when the scraping molds (32) hit the rifle line;

(c) the scraping molds (32) are lubricated;

(d) the volatile anti-oxidation lubricant (33) coats onto the clean aluminum rod (15) to protect it from secondary oxidation;

h. passing through an anti-friction nylon sleeve (38), the clean aluminum rod (15) exits from an orientation guide (21) thereafter for a following process of continuous extrusion.

2. The processing method as defined in claim 1 wherein the rifle line is carved-onto the round aluminum rod (13) by the rotational scraping tool when passing through the centrifugal scraping pretreatment unit (24) further comprising:

a. a wheel of which the rotational scraping tool is mounted on maintains in circular motion a constant angular speed Vω;

b. the rotational scraping tool is angled with respect to the round aluminum rod (13);

c. the round aluminum rod (13) maintains a liner motion speed $V_L$ by traction;

d. the rotational scraping tool carves the rifle line onto the round aluminum rod (13) by combining the liner motion axial speed $V_L$ of the round aluminum rod (13) and the circular motion angular speed $V_\omega$ of the rotational scraping tool;

e. the depth of the rifle line is set to be proportional to the diameter of the round aluminum rod (13).

3. The processing method as defined in claim 1 wherein the scraping molds (32) have round cutting edges wherein a. a mold cavity (26) sits in the working container (29) which is filled with the volatile anti-oxidation lubricant (33);

b. the mold cavity (26) is an open cone with gradually increased radius to avoid the clean aluminum rod (15) being scratched by an inner wall of the cavity due to vibration;

c. the cutting edges are angled with respect to the aluminum rod (14);

d. an uniformity by the diameter of the clean aluminum rod (15) is high;

e. when the round cutting edges hit the rifle line, the surface scrapings layer breaks into small pieces and falls into a collection tank;

f. the scraping depth ranges from 0.01 mm to 1 mm.

4. The processing method as defined in claim 1 wherein the volatile anti-oxidation lubrication fluid (33) is supported by a lubrication system which comprises of the volatile anti-oxidation lubrication fluid (33), a storage container (28), a pump (34), the working container (29) and connection pipes.

5. The processing method as defined in claim 1 wherein the volatile anti-oxidation lubricant (33) coated onto the surface of the clean aluminum rod (15) volatilizes upon the process of continuous extrusion.

6. The processing method as defined in claim 1 wherein the volatile anti-oxidation lubricant (33) includes but is not limited to alcohol, acetone, other volatile organic chemicals, or a combination thereof.

7. The processing method as defined in claim 1 can be extended to non-ferrous metals and alloys, such as copper and its alloys, or aluminum alloys.

* * * * *